United States Patent [19]

Isoard

[11] 4,206,883

[45] Jun. 10, 1980

[54] METHOD AND APPARATUS FOR TRANSFERRING TEXTILE YARNS FROM A FIRST TREATMENT ZONE TO A SECOND

[75] Inventor: Bernard Isoard, Lyons, France

[73] Assignee: Rhone-Poulenc-Textile, Paris, France

[21] Appl. No.: 948,102

[22] Filed: Oct. 3, 1978

[51] Int. Cl.[2] ..... B65H 54/02

[52] U.S. Cl. ..... 242/18 G; 242/18 DD; 242/18 PW

[58] Field of Search ..... 226/158; 242/18 G, 18 DD, 242/18 PW

[56] References Cited

U.S. PATENT DOCUMENTS

| | | | |
|---|---|---|---|
| 2,352,781 | 7/1944 | Fletcher | 242/18 G |
| 2,377,771 | 6/1945 | Fletcher | 242/18 G |
| 2,846,157 | 8/1958 | Stephens | 242/18 G |

FOREIGN PATENT DOCUMENTS

| | | | |
|---|---|---|---|
| 2133172 | 1/1972 | Fed. Rep. of Germany | 242/18 DD |
| 1423275 | 11/1965 | France | 242/18 G |
| 2286895 | 10/1975 | France | 242/18 G |
| 2300832 | 2/1976 | France | 242/18 G |

*Primary Examiner*—Edward J. McCarthy

*Attorney, Agent, or Firm*—Sherman & Shalloway

[57] ABSTRACT

A method and apparatus for transferring at least one textile yarn fed continuously from a first to a second treatment zone, in which:

the yarn is removed at the first treatment zone, while keeping it under tension;

the yarn is moved from the first to the second treatment zone by means of a member movable between the two zones, while continuing to remove the yarn; and the yarn is seized at the second treatment zone so as to position it in the desired place in that zone.

11 Claims, 3 Drawing Figures

Figure 1:
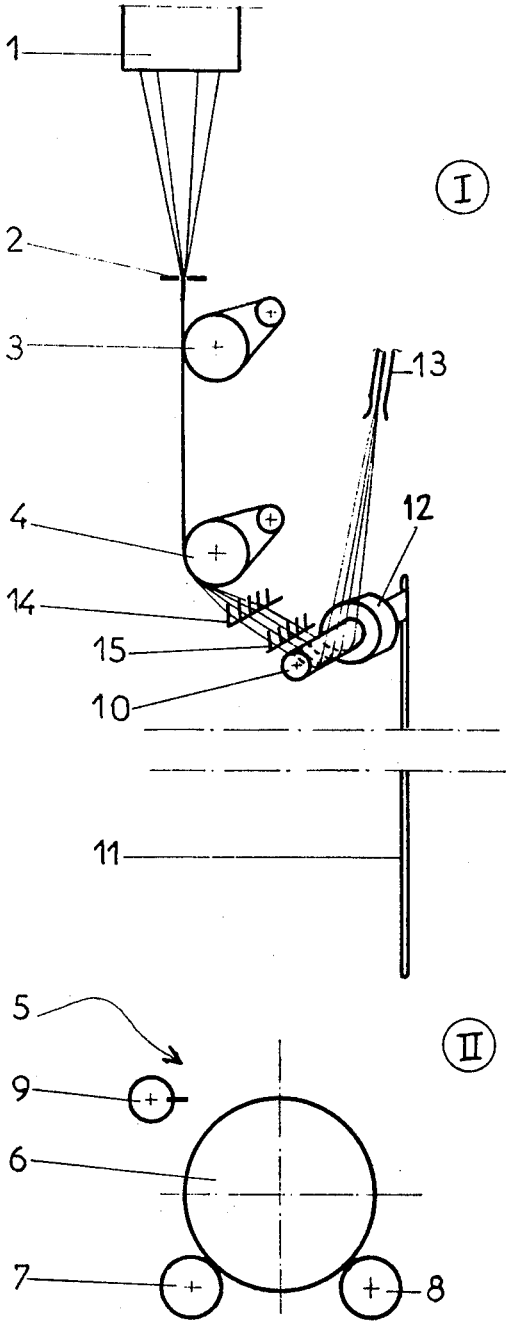

METHOD AND APPARATUS FOR TRANSFERRING TEXTILE YARNS FROM A FIRST TREATMENT ZONE TO A SECOND

The present invention relates to a method and apparatus for transferring textile yarns from a first treatment zone to a second.

In the textile industry, the operation of transfer of yarns finds numerous applications such as the starting of machines, the passing of yarns through the floor in the case of processes which are operated on at least two stories, and, in general, any occasion where it is desired to pass a yarn, travelling at high speed, automatically from one treatment device to another treatment device; the above list is not intended to be exhaustive.

Usually, pneumatic means are used for the transfer of yarns in the above cases. Thus, French Pat. No. 2,055,924 claims a method and a device for transferring yarns by means of a fixed pneumatic nozzle located at the first treatment zone, according to which method the yarn as well as the air injected by the nozzle is guided from the outlet of the nozzle to the second treatment zone by means of a guide channel which connects the nozzle to the second treatment device. At the second treatment zone, the yarn is first run to waste pneumatically, before being taken up by a handling device which places it in the desired position. The above device in general proves satisfactory. However, it entails a consumption of air which for yarns of medium gauge (160 to 200 dtex) is of the order of 20 to 70 $m^3$ (S.T.P.)/hour per yarn.

It is now usual to transfer several yarns (16 to 24, or more) simultaneously. This is what takes place when starting a spinning station. This represents a high instantaneous consumption which, in the case of a large number of stations, will be repeated frequently. It is thus necessary to have a high capacity installation capable of providing this amount of air.

Moreover, the use of pneumatic nozzles produces nuisances from the noise point of view. Furthermore, if it is desired to transfer a large number of yarns (16 to 24 yarns, or more) simultaneously, it is necessary to ensure that each yarn adheres to its own path, and that any interlacing is avoided.

According to the present invention there is provided a method of transferring at least one moving textile yarn, fed and treated continuously, from a first treatment zone to a second treatment zone which are separated from one another by a distance such that an operator located in one of the two zones cannot reach the other zone, said method comprising the steps of:

removing the yarn at the first treatment zone, whilst keeping it under tension, moving of the yarn from the first to the second treatment zone by means of a component which is movable between these two zones, whilst the yarn continues to be removed, and seizing the yarn at the second treatment zone so as to position it in the desired place.

In one form of carrying out this method the removal of the yarn at the first treatment zone is effected by picking up the yarn with a pneumatic means of running the yarn to waste and passing the yarn around a guide which can be moved from the first to the second treatment zone, and the yarn guide acts as said movable component and takes with it the yarn which thus describes a to-and-fro path between the two zones whilst continuing to be removed at the first zone and the seizing of the yarn at the second treatment zone is effected on the portion of the yarn executing the forward part of the to-and-fro movement and located upstream from the guide, preferably by means of a handling device capable of seizing a yarn which is moving under tension. Advantageously, a pneumatic gun is used.

In a second arrangement, the yarn is removed from the first treatment zone by a pneumatic means of running it to waste, this pneumatic means then being moved from the first to the second treatment zone and thus constituting the component for moving the yarn and the yarn is seized by means of a handling device capable of seizing a yarn moving under tension. Advantageously, a pneumatic gun is used.

The invention is applicable to the simultaneous transfer of several yarns, for example 16 to 24 or more. The tension imparted to the yarn is the tension needed to avoid the yarn working its way down the feed components and to maintain each yarn on a distinct and precise path until it reaches the movable component which provides their movement. In effect, it is necessary to avoid interlacing and furthermore each yarn must be capable of being seized selectively for the purpose of placing it in the desired position at the second treatment zone.

The above method is applicable to yarns travelling at high speeds, that is to say of the order of 4,000 to 6,000 meters/minute or more. Obviously, the means of running the yarn to waste, as well as the means of handling at the second treatment zone must be suitable for operating correctly at these speeds, in particular with the required tension conditions.

The invention also provides yarn treatment apparatus comprising a first treatment zone, a second treatment zone spaced from the first zone by a distance such that an operator located in one of said zones cannot reach the other, pneumatic means positionable in the first treatment zone for removing yarn from said first treatment zone, a member for moving the yarn thus removed from the first treatment zone to the second treatment zone and means at the second treatment zone for seizing the yarn from the member and positioning it in the second treatment zone.

According to a first embodiment, said member comprises a guide roller for the yarn, which can rotate and is translationally movable between the first and the second treatment zone.

The pneumatic means preferably runs the yarn to waste and is located at the first treatment zone, can be either fixed or movable whilst remaining in the said first zone. In the latter case, it advantageously consists of a pneumatic handling gun.

The roller which can rotate can be an idling roller and be driven rotationally by the yarn, or can be driven positively. For fine yarns which may be insufficiently strong to overcome the inertia of the roller, the latter will advantageously be driven positively. In this case, the drive is preferably provided by a slipping motor (a fluid turbine or an electrical slipping motor). The torque provided by the positive drive imparts to the roller a peripheral speed substantially equal to or slightly less than the speed of the yarn, allowing the yarn to slide over the roller. The positive drive assists the drawing-off of the yarn. It thus maintains a minimum tension in the upstream yarn, which avoids the yarn from working its way down on the feed components of the first treatment zone, and gives each yarn a precise path. It also avoids an increase in tension acting on the downstream yarn, which tension could be disadvantageous in the case of fine yarns. The translational movement of the roller between the first and the second treatment zone is effected by any known means such as a rack, belts, jacks, a linear electric motor or the like.

According to a second embodiment of apparatus, the member for moving the yarn comprises the pneumatic yarn removing means, which is mounted so as to be movable from the first to the second treatment zone.

The pneumatic component for running the yarn to waste is advantageously of the handling gun type. However it is integrally fixed to a carriage which can travel translationally between the first and the second treatment zones. The compressed air is supplied, and the air and the yarn are removed, by means of flexible tubes.

In either embodiment, the means of handling of the yarn, capable of seizing a yarn moving under tension at the second treatment zone, is advantageously a pneumatic means comprising a nozzle for catching the yarn and carrying it along, such as that described in British Pat. Nos. 1,489,615 and 1,504,992.

The said nozzle in particular comprises a passage channel widening out from upstream to downstream and provided with a catching slit running along a generatrix and two feed lines for the gaseous fluid, substantially parallel to the axis of the channel and opening into the latter. Such a nozzle makes it possible to seize a yarn travelling under tension and at high speed (6,000 meters/minute or more).

Where it is a matter of transferring several yarns simultaneously, which is frequently the case, means are provided for keeping the yarn separate, at least on the upstream portion of the yarn relative to the roller and on the roller. These means can simply be guides or separator combs. For example, a first separator comb may be located at the outlet of the first treatment zone and a second separator comb is located immediately upstream from the roller and translationally integral with the latter. These separator means assist the selective seizing of the yarns, which may be seized individually or in groups at the second treatment zone, for the purpose of placing them in position.

In order that the invention will be better understood, the following description is given, merely by way of example, reference being made to the accompanying drawings.

Figure 2:
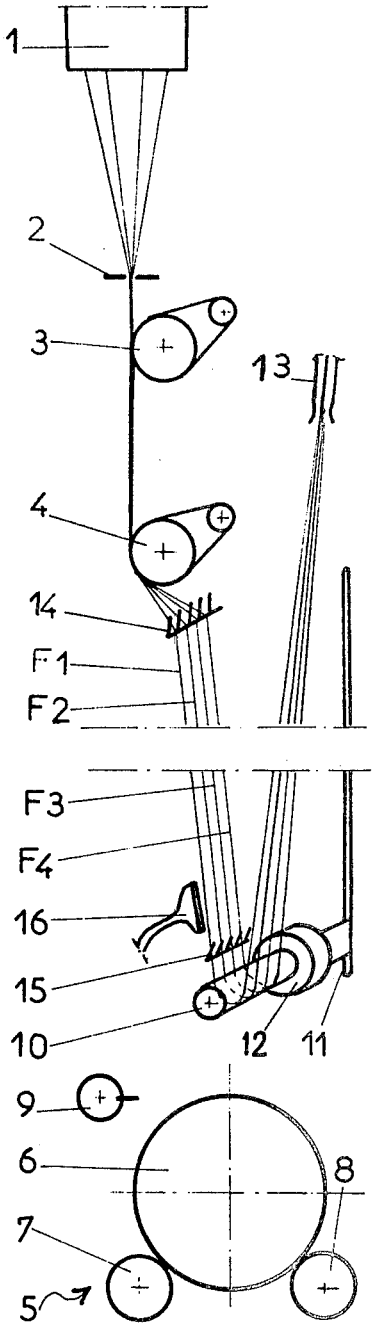
Figure 3:
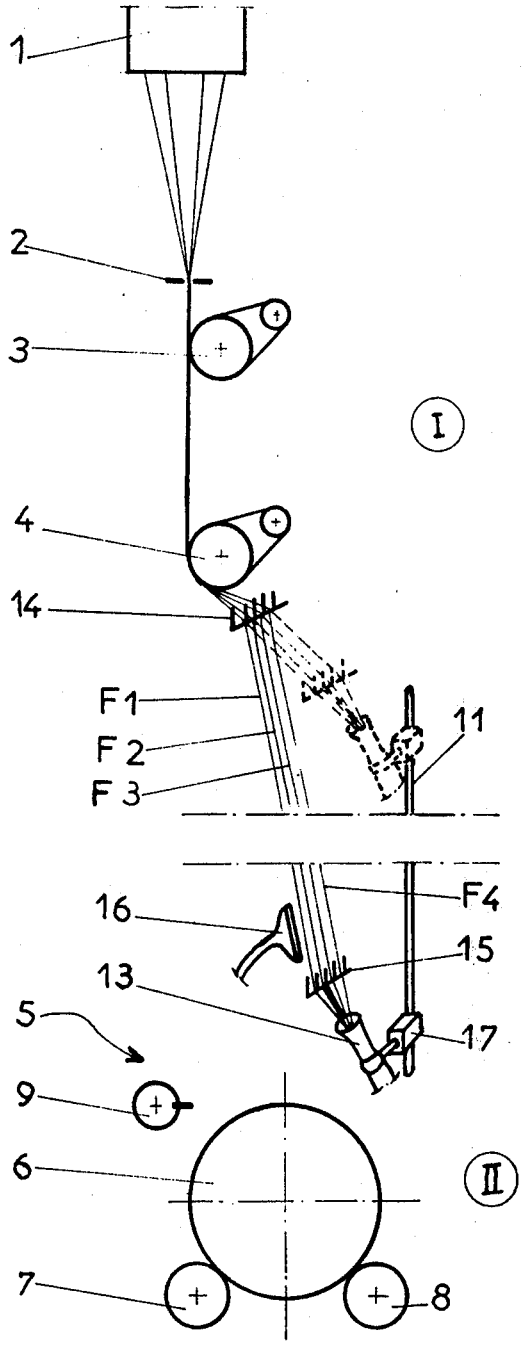

FIGS. 1 and 2 schematically illustrate a first embodiment of apparatus according to the invention with a movable roller; and FIG. 3 illustrates a second embodiment.

The following description relates to the transfer of a yarn, in spinning, from an upper story where the yarn is spun and drawn to a lower story where the yarn is wound up (if appropriate after cooling by exposure to the atmosphere between the two story).

FIGS. 1 and 2 schematically show a melt spinning installation, for example for polyester spinning, with an upper level I where spinning and drawing takes place and a lower level II for the wind-up. The filaments extruded from a spinning device 1 pass through a cooling cell which is not shown and are collected as four separate yarns F1, F2, F3 and F4 at a convergence guide 2. The four yarns are continuously taken up and are drawn simultaneously between a set of feed rollers 3 and a set of draw rollers 4. On leaving the drawing rollers 4 the yarns must be transferred onto a wind-up device 5 at the lower level, where the winding-up takes place. The device comprises a pilot cylinder 6, in frictional contact with two spindles 7 and 8, each intended to receive two windings. The function of the pilot cylinder 6 is to determine the peripheral speed of the wind-up device whilst providing all or part of the torque required to drive the device. The yarn is distributed over the length of the spindles in a reciprocating motion provided by a reciprocating device 9. The yarns are transferred from level I to level II by the method of the invention, which in this construction involves the use of a rotating roller 10, translationally movable on a slide rail 11 between the level I and the level II. The roller is driven rotationally, with a peripheral speed substantially equal to the speed of travel of the yarns, by means of a turbine 12 operated by a gaseous fluid. A gun 13 is used for handling the yarn and running it to waste, the gun being located at level I, and by two separator combs 14 and 15, located upstream from the roller 10, the comb 14 being fixed and the comb 15 being integral with the roller 10 as regards translational movement.

In use, on leaving the set of draw rollers 4, the four yarns F1, F2, F3 and F4 are handled by an operator by means of the gun 13. The yarns are passed through the separator comb 14, through the comb 15, and round the rotationally driven roller 10, and are run to waste by means of the gun 13. The four yarns follow identical but separate paths between the convergence guide 2 and the gun 13; in particular, they remain well separated on the roller 10. The roller 10 is then lowered to the wind-up level II. When the roller 10 has reached its point of arrival at level II, the four yarns follow the paths shown in FIG. 2, whilst continuing to be drawn off by the gun 13. They are then seized one after the other by the catching nozzle 16, handled by an operator, and are anchored to their respective spindles, for example F1 and F2 to spindle 7 and F3 and F4 to spindle 8. As already indicated, the nozzle 16 is of the type described and claimed in British Patent Specification Nos. 1,489,615 and 1,504,992. The roller 10 is driven by the turbine 12 in the case of fine or medium yarns (160 to 200 dtex). For heavy gauge yarns, the turbine can be omitted. The roller is mounted idling; it is driven by the yarns without interfering with the travel of the latter.

By way of example, a device such as that shown schematically above makes it possible to transfer from 16 to 24 yarns of 50 dtex/22 strands, travelling at 4,000 meters/minute, whilst maintaining sufficient tension between the drawing unit 4 and the gun 13; this tension is greater than 10 g. Compared to the pneumatic transfer device, the above device allows a saving of compressed air of the order of 20 to 70 $m^3$ (S.T.P.)/hour/yarn, even allowing for the amount of air required to drive the turbine 12.

A high capacity air installation is no longer necessary. Furthermore, the nuisance created by the noise of compressed air in the conventional transfer device is avoided. In addition, the yarns remain well-separated and can be seized perfectly by the nozzle 16.

In the arrangement of FIG. 3, the spinning installation is the same as in FIGS. 1 and 2 and the same reference numbers denote the same components. The transfer device consists of the nozzle 13, mounted so as to slide on the slide rail 11 between level I and level II. The separator comb 15 is integral with the nozzle 13. Advantageously the nozzle 13 is mounted on the slide rail 11 by means of a carriage 17 which is permanently mounted slidingly on the slide rail 11. The nozzle is mounted removably on the carriage, which makes it possible to use it as a handling gun for positioning the yarns around the drawing unit 3 and 4 and then to fix it to the carriage 17 for the transfer operation. The nozzle 13 can also be permanently mounted slidingly on the slide rail 11. In that case it can be necessary to use a separate handling gun for the positioning of the yarns at level I. Flexible tubes which can be folded and unfolded depending on the position of the nozzle 13 on the slide rail are advantageously used for the air feed of the nozzle 13 and for removing the yarns to waste.

In operation, the yarns are positioned in the device 3–4, and then in the comb 14, by means of the nozzle 13. The nozzle 13 is firmly fixed to the carriage 17 after having taken care to position the yarns correctly in the comb 15 (as shown in broken lines). The transfer is effected by causing the carriage 17 and the nozzle 13 to descend to the lower position, at level II, whilst the yarns continue to be drawn off and removed by the nozzle 13. The positioning of each yarn on its wind-up spindle 7 or 8 is effected by means of the catching nozzle 16, as in the preceding case.

Obviously, as has already been indicated, the invention, regardless of its embodiment, is not restricted to the transfer of four yarns. It permits the simultaneous transfer of a number of yarns which can be as much as 16 to 24, or even more. Equally, it is applicable to yarns of all gauges and of artificial, synthetic or mineral origin, fed continuously at a high speed, of the order of 4,000 to 6,000 meters/minute, or more.

I claim:

1. A method of transferring at least one moving textile yarn, fed and treated continuously, from a first treatment zone to a second treatment zone which are separated from one another by a distance such that an operator located in one of the two zones cannot reach the other zone, said method comprising the steps of:

removing the yarn at the first treatment zone, whilst keeping it under tension, moving of the yarn from the first to the second treatment zone by means of a component which is movable between these two zones, whilst the yarn continues to be removed, and seizing the yarn at the second treatment zone so as to position it in the desired place.

2. A method according to claim 1, wherein the removal of the yarn at the first treatment zone is effected by picking up the yarn with a pneumatic means of running the yarn to waste, and passing the yarn around a guide which can be moved from the first to the second treatment zone, wherein the yarn guide acts as said movable component and takes with it the yarn which thus describes a to-and-fro path between the two zones whilst continuing to be removed at the first zone and the seizing of the yarn at the second treatment zone is effected on the portion of the yarn executing the forward part of the to-and-fro movement and located upstream from the guide, by means of a handling device capable of seizing a yarn which is moving under tension.

3. A method according to claim 1, wherein the yarn is removed from the first treatment zone by a pneumatic means of running it to waste, this pneumatic means then being moved from the first to the second treatment zone and thus constituting the component for moving the yarn and wherein the yarn is seized by means of a handling device capable of seizing a yarn moving under tension.

4. A method according to claim 1, wherein at least two yarns are transferred, wherein the removal of the yarns and the movement of the yarns from the first to the second zone are effected simultaneously for all the yarns and that the seizing, at the second zone, and the positioning are effected separately for each yarn.

5. Textile treatment apparatus comprising a first treatment zone, a second treatment zone spaced from the first zone by a distance such that an operator located in one of said zones cannot reach the other, pneumatic means positionable in the first treatment zone for removing yarn from said first treatment zone, a member for moving the yarn thus removed from the first treatment zone to the second treatment zone and means at the second treatment zone for seizing the yarn from the member and positioning it in the second treatment zone.

6. Apparatus according to claim 5, wherein said member comprises a rotating guide roller and means for translationally moving said roller from the first to the second treatment zone.

7. Apparatus according to claim 6, wherein said guide roller is an idling roller.

8. Apparatus according to claim 6, wherein said guide roller is a positively driven roller.

9. Apparatus according to claim 5, wherein the member for moving the yarn comprises the pneumatic yarn removing means, which is mounted so as to be movable from the first to the second treatment zone.

10. Apparatus according to claim 5 and further comprising means of separation of the yarns, located upstream from the movable member for moving the yarn.

11. Apparatus according to claim 5, wherein the first treatment zone comprises an upper spinning and drawing station and the second treatment zone comprises a lower yarn wind-up station.

* * * * *